United States Patent [19]

Austin et al.

[11] Patent Number: 4,840,723

[45] Date of Patent: Jun. 20, 1989

[54] HYDROCARBONS PYROLYSIS

[75] Inventors: Frederick D. Austin; John L. Barclay, both of Surrey; James O. Hunter, Sunbury-on-Thames, all of England

[73] Assignee: The British Petroleum Company p.l.c., London, England

[21] Appl. No.: 246,036

[22] Filed: Sep. 15, 1988

Related U.S. Application Data

[63] Continuation of Ser. No. 946,575, Nov. 13, 1986, abandoned.

[30] Foreign Application Priority Data

Mar. 28, 1985 [GB] United Kingdom ..... 8508103

[51] Int. Cl.[4] ..... C01G 9/38

[52] U.S. Cl. ..... 208/106; 208/107; 208/48 Q; 208/128; 208/129; 585/648; 585/652

[58] Field of Search ..... 208/106, 107, 128, 129, 208/48 Q; 548/648, 649, 650, 652

[56] References Cited

U.S. PATENT DOCUMENTS

| | | | |
|---|---|---|---|
| 2,678,956 | 5/1954 | Hasche | 585/539 |
| 2,985,698 | 5/1961 | Pechtold et al. | 585/324 |
| 3,855,339 | 12/1974 | Hosoi et al. | 208/128 |
| 3,907,661 | 9/1975 | Gwyn et al. | 208/48 Q |
| 4,016,066 | 4/1977 | Shiraiwa et al. | 208/48 Q |
| 4,214,979 | 7/1980 | Nakanishi et al. | 208/128 |
| 4,233,137 | 11/1980 | Ozaki et al. | 208/48 Q |
| 4,256,565 | 3/1981 | Friedman et al. | 208/129 |
| 4,264,432 | 4/1981 | Gartside | 208/106 |
| 4,599,479 | 7/1986 | Okamoto et al. | 208/107 |
| 4,613,426 | 9/1986 | Okamoto et al. | 208/129 |

*Primary Examiner*—Anthony McFarlane
*Attorney, Agent, or Firm*—Morgan & Finnegan

[57] ABSTRACT

Methane and liquid hydrocarbon feeds boiling above 350° C. are reacted by feeding finely divided droplets into hot gas at not more than 2 MPa containing at least 50% volume methane and not more than 15% volume hydrogen.

9 Claims, No Drawings

HYDROCARBONS PYROLYSIS

This is a continuation of co-pending application Ser. No. 946,575, filed on Nov. 13, 1986 now abandoned.

BACKGROUND OF THE INVENTION

The present invention relates to the production of lower boiling hydrocarbons by the reaction of higher boiling liquid hydrocarbons presence of methane and refinery off gases containing methane.

EP 89 310 discloses a process in which residual oil is sprayed into a hot gas containing methane. However the specification requires the use of hydrogen present in quantities such as to give a partial pressure of at least 0.3 MPa. The total pressures disclosed are of 2 MPa or higher. There is no suggestion that methane can react to give increase the amount of liquid cracking products, and the specification indicates that under the (high pressure) conditions used the use of high ratios of methane to hydrogen is disadvantageous.

In many parts of the world there are large deposits of natural gas. It would be desirable if this natural gas could be used to produce liquid hydrocarbons which would be more useful as fuels. Considerable amounts of higher boiling hydrocarbons whose molecular weight is too high for them to be satisfactory fuels for many purposes, particularly for transport, are also available in many countries. It would be desirable to find a way of producing relatively low boiling liquid hydrocarbons from both methane and high boiling hydrocarbons, preferably using the same process.

We have now found that by suitable choice of reaction conditions methane can be reacted with higher hydrocarbons so as to increase the yield of liquid cracking products.

DETAILED DESCRIPTION OF THE INVENTION

According to the present invention the process for the pyrolysis of a liquid hydrocarbon feed boiling at a temperature above 350° C. which comprises introducing the hydrocarbon feed in the form of finely divided droplets into a hot gas, which gas is at a pressure of not more than 2 MPa and which contains at least 50% volume of methane and not more than 15% volume hydrogen, the temperature of the reaction mixture into which the droplets are fed being in the range 600° to 1400° C., followed by reduction of the temperature of the reaction mixture to below 300° C. in less than 100 milliseconds.

The liquid hydrocarbon may be a residue from the distillation of petroleum under atmospheric pressure ("atmospheric residue") but is preferably a residue from the vacuum distillation of petroleum ("vacuum residue") e.g. boiling at temperatures above 500° C. The hydrocarbon is preferably pre-heated before it is fed into contact with the hot gas. Examples of suitable pre-heat temperatures are 100° to 400° C. preferably 100° to 300° C., more preferably 100° to 250° C. e.g. 200° C. Preferably the maximum preheat temperature used is below that at which any significant coking of the feed takes place.

The hydrocarbon is fed into the hot gas in the form of liquid droplets. The droplet size is preferably in the range 1 to 100 micrometers, in order to obtain rapid heating.

The droplets of liquid hydrocarbon are preferably fed into a reaction mixture which is at a temperature of 600° to 1400° C., preferably 600° to 1200° C. When using the preferred low liquid hydrocarbon preheat temperature the inlet gas temperature of the gas will need to be at a higher temperature than the reaction mixture.

The gas is preferably at a pressure not more than 1 MPa.

The hot gas contains at least 50% volume methane, preferably at least 65%. The hydrogen content is not more than 15% volume, preferably not more than 10% by volume, more preferably not more than 5% volume.

The hot gas may be produced by externally heating the gas. However the hot gas may also be produced by partial combustion of a methane-containing gas.

The methane-containing gas may be substantially pure methane, or may be natural gas. In petroleum refining various gases containing substantial amounts of methane, together with higher hydrocarbons (known as "refinery off gases") are produced and these may also be used as the feed.

The partial oxidation step is operated so as to leave at least 50% volume methane in the partial oxidation product, and it is therefore necessary to control the amount of oxygen brought into contact with the methane-containing gas. In order to achieve the desired methane content in a partial oxidation process the maximum volume percent of oxygen in the gaseous feed will be about 15% and is preferably not more than 11% volume.

It is preferred to keep the water content of the hot gas below 12% volume.

The reaction must be quenched within a very short time (less than 100 milliseconds) of the hydrocarbon being brought into contact with the hot gas. This will normally imply that the hot gas is moving at a relatively high velocity so as to carry the reaction products into the quenching zone within the required time limit of 100 milliseconds, preferably within less than 30 milliseconds, of the hydrocarbon being brought into contact with the hot gas.

The methane in the hot gas is a reactant which is converted and incorporated into higher molecular weight gaseous and liquid products, which are more useful.

It also reduces the deposition of coke. The weight ratio of methane to liquid hydrocarbon is preferably in the range 5:1 to 1:1, more preferably 3:1 to 1:1.

The relative quantities of hot gas and liquid hydrocarbon used will be determined by the need to introduce sufficient heat into the liquid hydrocarbon and is preferably in the range 1.5:1 to 2.5:1 eg 2:1 by weight.

The quenching step may be carried out with a liquid or gaseous quenching medium. Methods of quenching will be well known to those skilled in the art.

The invention will now be illustrated with reference to the following examples.

COMPARATIVE TEST A

This experiment, not according to the invention, shows the results of carrying out a cracking step with a gas which does not contain methane.

The apparatus used comprised a vertical tubular reactor of inside diameter 5 mm and length 762 mm made of aluminium oxide mounted in a furnace. Liquid was introduced at the rate of 2 g/min through 4 hypodermic needles at the top of the reactor. Gaseous feed was introduced at the top of the reactor at the rate of 5 liter/min. The high velocity of the gas atomised the liquid feed. The reaction product was quenched to below 300° C. in a T-piece at the bottom of the reactor outside the furnace. The liquid feed used was a deasphalted Kuwait oil which had an initial boiling point of 391° C.

The oil feed was pre-heated to 150° C. before injection. Because of equipment limitations the gas feed, which was nitrogen, could only be pre-heated to 600° C. Additional heat was supplied by the furnace to raise the temperature of the reactor to ca. 1000° C.

The residence time in the reactor (before quenching) was 20–25 milliseconds.

The weight ratio of gas to oil was 2:1.

It was found that 10% by weight of the oil fed was converted to coke, 6% by weight was converted to liquid products, and 59% by weight of the oil was converted to gases (20% $CH_4$).

EXAMPLE 1

This is an example of the invention. An experiment was carried out as in Test A, except that the hot gas contained 100% volume of methane.

7% of the oil fed was converted to coke, 10% of the oil was converted to liquid products and 33% of the oil was converted to gaseous products. In addition 8% of the methane fed was consumed.

COMPARATIVE TEST B

Same equipment and conditions as Test A but uses Forties atmospheric residue with nitrogen. 8% of oil fed was converted to coke, 8% to light liquids and 49% converted to gases; (8% $CH_4$).

EXAMPLE 2

Similar equipment as Example 1 but gas preheated to 800° C., using Forties atmospheric residue with methane. 4% of oil fed was converted to coke, 10–20% to light liquids and 43% converted to gases. In addition 12% of the methane fed was converted.

EXAMPLE 3

Same as Example 2 except gas preheated to 900° C. with reactor at ca. 900° C. and water quench. 2% of oil fed was converted to coke, 10–20% to light liquid and 37% converted to gases. In addition 5% of the methane fed was converted.

We claim:

1. A process for the pyrolysis of a liquid hydrocarbon feed boiling at a temperature above 350° C. which comprises introducing the hydrocarbon feed in the form of finely divided droplets into a hot gas which gas is at a pressure of not more than 1 MPa and which contains at least 65% volume of methane and not more than 10% volume hydrogen, the temperature of the reaction mixture into which the droplets are fed being in the range 600° C. to 1400° C. followed by reduction of the temperature of the reaction mixture to below 300° C. in less than 30 milliseconds, the proportion of steam in the hot gas being not more than 12% by volume.

2. The process according to claim 1 wherein the gas contains not more than 5% by volume of hydrogen.

3. The process according to claim 2 wherein the gas consists substantially only of methane.

4. The process according to claim 1 wherein the liquid hydrocarbon feed is residue of a distillation of a petroleum oil under atmospheric pressure.

5. The process according to claim 1 wherein the liquid hydrocarbon feed is a residue of a vacuum distillation of petroleum.

6. The process according to claim 1 wherein the hot gas is produced by the partial oxidation of methane.

7. The process according to claim 6 wherein the proportion of oxygen in the gaseous feed to the partial oxidation process is not more than 15% volume.

8. The process according to claim 7 wherein the proportion of oxygen in the gaseous feed to the partial oxidation process is not more than 10% by volume.

9. The process according to claim 1 wherein the weight ratio of hot gas to liquid hydrocarbon feed is in the range 1.5:1 to 2.5:1.

* * * * *